United States Patent [19]

Kovit et al.

[11] 4,443,014

[45] Apr. 17, 1984

[54] COMBAT SIMULATOR MEANS

[76] Inventors: Bernard Kovit, 41 Wood La., Woodsburgh, N.Y. 11598; Richard G. Koenig, 258 Shore Rd., Mount Sinai, N.Y. 11766; Robert W. Kress, 27 Mill Rd., Lloyd Harbor, N.Y. 11743

[21] Appl. No.: 287,365

[22] Filed: Jul. 27, 1981

[51] Int. Cl.[3] ..... F41J 9/08; A63H 27/02; A63H 30/04

[52] U.S. Cl. ..... 273/363; 46/76 R; 244/190; 273/365; 434/14

[58] Field of Search ..... 434/14, 15, 22; 273/359, 362, 363, 365, 312, 313; 244/189, 190; 46/76 R

[56] References Cited

U.S. PATENT DOCUMENTS

| | | | |
|---|---|---|---|
| 2,404,653 | 7/1946 | Plebanek | 273/312 X |
| 2,530,725 | 11/1950 | Pizer | 46/76 R X |
| 3,011,114 | 11/1961 | Steeb | 244/190 X |
| 3,104,478 | 9/1963 | Strauss et al. | 434/22 |
| 3,957,230 | 5/1976 | Boucher et al. | 244/190 X |
| 4,126,312 | 11/1978 | Kreuzer et al. | 273/359 |

*Primary Examiner*—William H. Grieb
*Attorney, Agent, or Firm*—Richard G. Geib

[57] ABSTRACT

A device adaptable to inexpensive models to operate either in a mode of being attacked or an attack mode that permits sequential shooting of energy within a predetermined angle profile and, within range limits, the receipt of such energy whereupon visual indication of a successful attack can be indicated.

9 Claims, 4 Drawing Figures

COMBAT SIMULATOR MEANS

BACKGROUND

Heretofore combative competitions have been known with airplane models, and especially radio controlled models. In the case of radio controlled airplane models one such model has affixed thereto a colored ribbon and the other airplane must make physical contact with the ribbon to win the competition. It has not been known how to create more realistic competitions between other remotely controlled vehicles, i.e., boats, trucks, tanks, etc., nor how to devise a way to simulate ground-to-air or air-to-ground attacks or the like.

SUMMARY

It is a principal purpose of the disclosure within these Letters Patent to advance the knowledge of those skilled in the art with respect to a much more practical and realistic simulation of combative competitions between models or toys than aforedescribed so as to employ a far broader range of combat maneuvering skills to the benefit of improving proficiency of the combatants.

It is also a preferred objective to, with such disclosure, teach those skilled in the art so as to broaden the competitive combat simulation to engagements between model tanks, ships, air to ground, ground to air, etc.

DRAWING DESCRIPTION

DETAILED DESCRIPTION

Figure 1:
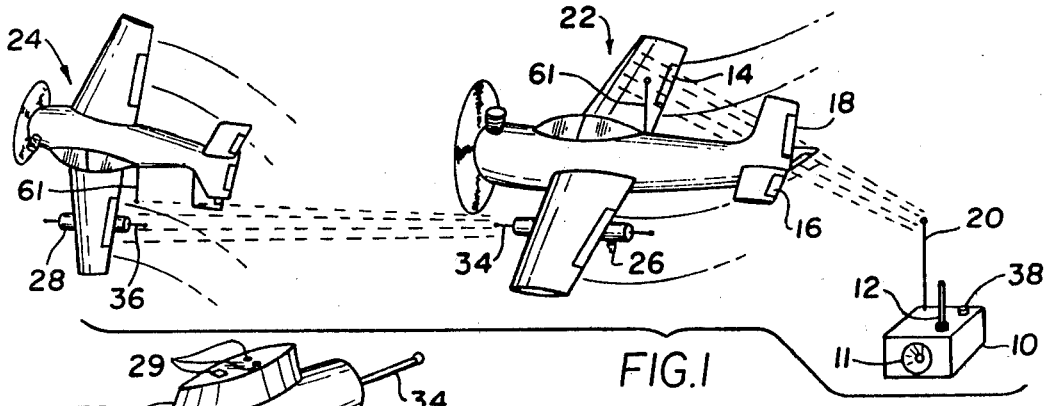
FIG. 1 is a pictorial presentation of an aerial combat simulation with a ground controller of one radio model airplane commanding energy transfer to another radio controlled model.

With more particular regard to FIG. 1 there is shown a ground controller 10 familiar to those skilled in the art of remotely controlled radio models or toys. This device includes the usual stick controller(s) 12 free to move in all axes for control of ailerons 14, elevators 16 and rudder 18 by reason of energy being broadcast by antenna 20 to the antenna 61 on airplane 22. The ground controller 10 can be adapted to emit audio sounds of gunfire bursts from its speaker 11 upon activation of the shoot button 38. Airplane 24, in this case the one to be attacked, is similarly controlled from the ground. To these model airplanes 22 and 24 there are detachably mounted pods 26 and 28, respectively as by means of releasable connections (not shown) with connections 29 on the pods (see FIG. 2). Or the pod equipment can be internal to the model.

Figure 2:
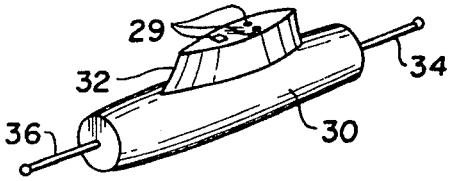
FIG. 2 is an isometric view of a detachable pod for the airplanes of FIG. 1 that will transmit energy and receive same in one or the other possible operative modes.

FIG. 2 shows pads 26 and 28 in larger detail to include an aerodynamically shaped body 30 with a mounting pylon 32 for connections 29 and fore and aft antennas 34 and 36. While for purposes of manufacturing practicalities these pods 26 and 28 are identical in this preferred embodiment one may without departing from the scope of our invention manufacture single purpose pods, i.e., pods that function to transmit and pods that function to receive.

In the environment shown by our FIG. 1 the airplane 22 is attacking airplane 24 and sequential bursts of energy from antenna 34, under control of the shoot button 38 on controller 10, will be, so long as the receiving antenna 36 of pod 28 on airplane 24 is in the cone of transmission from antenna 34 of pod 26 on airplane 22, received by the pod 28 of airplane 24 and a hit will be registered.

Electrical connections (not shown) within the skill of the art to control release of smoke, to project an ejection seat or to cut power on the engine, of airplane 24 to visually (audibly) indicate a "hit," i.e., signify a "kill," connect the pod to a controllable servomotor (not shown) for such apparatus as will be within the skill of the art of model airplane persons to adapt to these airplanes 22 and 24.

Figure 3:
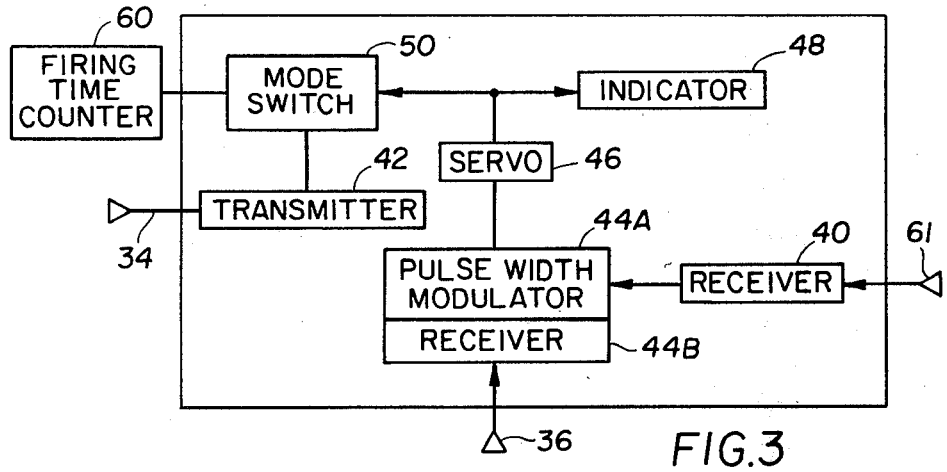
FIG. 3 is a functional schematic of the apparatus within the pod of FIG. 2.

With reference to FIG. 3 there is shown for use in pods 26 or 28 known energy transmitting and receiving devices 42 and 40, respectively. Receiver 40 is connected internally such that transmitted energy firing commands received via the normal model antenna 61 from the ground are routed unmodified to a servo 46, and mode switch 50 via a second receiver 44B and pulse width modulator 44A. That is to say the receiver 40 will obtain from the ground an energy command to put mode switch 50 in the attack mode firing the transmitter 42 to provide energy at antenna 34 of pod 26. The second receiver 44B in pods 26 or 28 will receive this energy if antenna 36 is substantially aligned with antenna 34 when a "hit" is to be scored. In that case the energy activates servo 46 to operate indicator 48 (smoke discharge device, ejection seat propulser, etc.) via servo 46. A fixing time counter 60 can be added in the pod to limit the allowable fixing time for realism.

Figure 4:
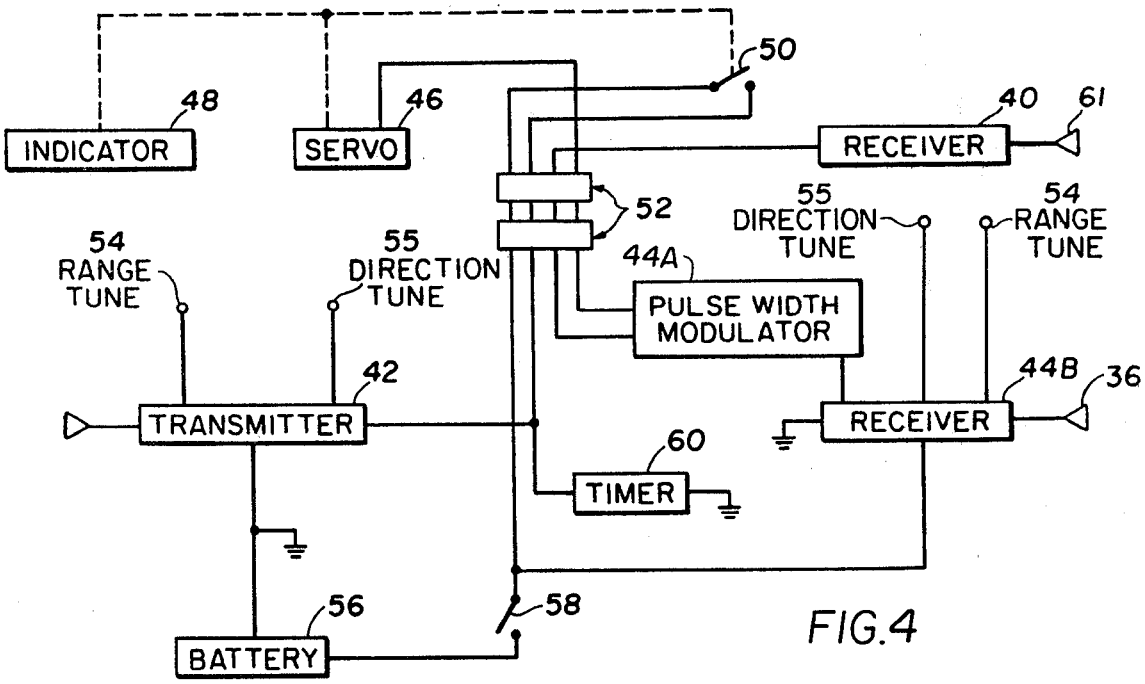
FIG. 4 is block diagram of the device details of the functional schematic of FIG. 3.

As is more particularly seen by FIG. 4 the receiver 40 is within the radio controlled airplane as is the servo 46 and mode switch 50. They are connected to the pod elements by a connector 52. The pod elements at present in a preferred embodiment include a readily available pulse width modulator 44A for code modification of information (energy) from receiver 40, a power source (battery) 56 with a simple on/off switch 58 and a timer circuit 60 to act as a firing time limiter control for transmission of energy from the transmitter 42, as well as the necessary lines (leads) from one of these to the other, as generally shown by FIG. 4.

The servo 46 is readily available in the marketplace in the preferred embodiment shown having a control that normally is in the neutral position as shown by FIG. 4. The arm of servo 46 will move right or left as a result of the varying pulse width of the signal from the modulator 44A either to close switch 50 to put the pod in a transmit or "fire" mode or to activate indicator 48 to show a "kill" resulting from signals being received at receiver 44B.

With the aforesaid model enthusiasts will have freedom not heretofore thought possible in simulating combat engagements or other interplay between vehicles, airplanes, ships and combinations thereof by specific actions initiated at a remote location.

As an example, aerial combat between two or more flying model airplanes would be made possible by installation of appropriate transmitter and receiver elements and other related action/reaction devices (actuators) in each of the combatant vehicles. The said transmitters and receivers would operate in various bands of the sonic or electromagnetic spectra.

The primary purpose of the item is to effect, as for example in the case of model aircraft, a most realistic simulation of aerial combat engagements (or "dog-fights") between radio-controlled or otherwise remotely piloted scale-model airplanes. It provides the operators a unique means for controlling a simulated combat engagement in which a victory (signified by an engine shut-down or who manages to maneuver into a position on his adversary's tail and fires a "burst" of energy ultrasonic pulses) so accurately as to be impressed on the receiving element on the other plane. (See FIG. 1). Each adversary would have available only a limited amount of firing time ("ammunition") by reason of the firing time limiter circuit 60.

The energy entering the receiving element would initiate one or more actuating devices (e.g., servomechanisms to produce one or more effects: engine shut-off and/or simultaneous release of a quantity of smoke from an appropriate generator or other device, signifying a "kill"). As will be readily appreciated any number of triggering means providing similarly effective and noticeable indicators could be devised upon an understanding of this disclosure.

The item is conceived as being packaged in the form of a kit, readily applied to any type and size of model. A kit would consist, for example, of identical sets of devices, one for each combatant, for achieving the abovedescribed engagement effects. Also, a regular model servo would be installed in each plane to initiate the firing of "bursts" of energy; such "bursts" would be initiated by the ground transmitter. This same servo could be used to initiate the smoke or engine cutout if the plane was "hit" in the manner described.

The unique design of the airborne transmitting and receiving devices establishes their directionality and range sensitivity within given restricted limits. This effectively establishes narrowed "cones" of transmission angle and range and, possibly, of reception so as to more closely simulate the effects of firing in real-world aerial combat. Thus, one opponent's transmitter will fire a narrow beam; the receiver, on the other plane, will be capable of taking the "burst" only from within a larger "cone" of reception. And both will be range-sensitive as well.

This provision also serves to establish the skill level required to master the dogfight, i.e., to score (or to avoid) a "kill." The described item can also incorporate a means 54 and 55 (see FIG. 4) for adjusting the range and directionality of the receivers and transmitters, thereby allowing adjustment of the degree of difficulty of an engagement. This also provides a means for establishing unique standards for dogfight or other "combat" tournament events.

Having described an operative construction and manner of use of our invention it is now desired to set forth the intended protection sought by these Letters Patent in the claims appended hereto.

We claim:

1. A simulator of combat engagement of a first means, said simulator including:

a remote control means;

a first receiver within the first means for the receiving signals of the remote control means for control of the first means, said first receiver also having a "fire" controlling and "kill" indicating output signals;

a connector having one portion thereof on said first means;

a detachable means for the first means having the other portion of the connector, a second receiver, a pulse width modulator, a transmitter and a hit counter in a circuit connected with the one portion upon assembly of detachable means to the first means to permit signals from the output signals of said first receiver to place said detachable means under command of said remote control means, said detachable means having mode control means to control operation of said first means either as a commanded passive target means to indicate combat effectiveness or as a firing means.

2. A process to simulate combat engagement, said process comprising the steps of:

directionally and range tuning a combat simulator receiver to a desired sensitivity in direction and range to effect varied skill requirements;

directionally and range tuning a combat simulator transmitter to a desired sensitivity in direction and range for increasing and decreasing skill requirements to effect a kill;

orienting a transmitter of one combatant in proximity of the receiver of another combatant;

transmitting energy from a remote location to start the attack program of the one combatant transmitter processing signals receiving by the other combatant receiver to an indicator means;

indicating a "kill " at the other combatant whenever the energy of the one combatant's transmitter signals of proper direction, range and duration are received by the the another combatant.

3. A combat simulator comprising:

a power source;

receiver means to receive control signals and signals indicating gunfire directed toward said receiver;

a counter means to time the duration of received signals and trigger when a preset duration is reached;

signal modulator means connected to said counter means to control signal output of said modulator means;

servo means connected by said signal modulator means to be operable in accordance with the output of said receiver, counter and modulator means;

"kill" indicator means connected to said servo means;

switch means connecting said power source to said receiver means, said counter means and said servo means; and transmitter means connected to said switch means and said power source to transmit timed signals simulating gunfire blasts.

4. In combination with the simulator of claim 3 a remote control means for control of said transmitter/-receiver means.

5. The simulator of claim 3 and further comprising directional tuning means for said receiver means.

6. The simulator pod of claim 3 and further comprising range tuning means for said receiver means.

7. The simulator of claims 3 or 4 and further comprising directional tuning means for said transmitter.

8. The simulator of claims 3 or 4 and further comprising directional and range tuning means for said transmitter.

9. The simulator of claims 3 or 4 and further comprising directional and range tuning means for said transmitter and directional and range tuning means for said receiver means.

* * * * *